US006289546B1

(12) United States Patent
Harada

(10) Patent No.: US 6,289,546 B1
(45) Date of Patent: Sep. 18, 2001

(54) TOOTHBRUSH AND METHOD OF FABRICATING SAME

(76) Inventor: Stephen D. Harada, 614 Blair Ave., Piedmont, CA (US) 94611

( * ) Notice: Subject to any disclaimer, the term of this patent is extended or adjusted under 35 U.S.C. 154(b) by 0 days.

(21) Appl. No.: 09/280,383

(22) Filed: Mar. 29, 1999

(51) Int. Cl.[7] ..... A46B 5/02

(52) U.S. Cl. ..... 15/167.1; 15/143.1; 15/DIG. 5; 16/430; D4/104; D4/110

(58) Field of Search ..... 15/DIG. 5, 167.1, 15/167.2, 167.3, 143.1, 164, 160, 159.1, 187, 188; D4/104, 111, 105, 128, 129, 133, 138; 16/430, 421, 426, 446

(56) References Cited

U.S. PATENT DOCUMENTS

| | | | | |
|---|---|---|---|---|
| D. 140,438 | * | 2/1945 | Cohen . | |
| D. 156,473 | * | 12/1949 | Ackerman . | |
| D. 179,651 | * | 2/1957 | Mayer . | |
| D. 190,318 | | 5/1961 | Vallis | D4/129 |
| D. 299,386 | | 1/1989 | Jacobs | D4/104 |
| D. 321,092 | | 10/1991 | Woll et al. | D4/106 |
| D. 324,958 | | 3/1992 | Piano | D4/104 |
| D. 342,160 | | 12/1993 | Curtis et al. | D4/104 |
| D. 370,347 | | 6/1996 | Heinzelman et al. | D4/104 |
| D. 389,312 | | 1/1998 | Porter | D4/104 |
| D. 404,921 | | 2/1999 | Smith | D4/104 |
| D. 419,306 | * | 1/2000 | Hansen et al. . | |
| 726,727 | | 4/1903 | Mills | 15/188 |
| 1,257,883 | | 2/1918 | Kone . | |
| 1,517,320 | | 12/1924 | Stoddart | 15/22.1 |
| 2,066,772 | * | 1/1937 | Doyle . | |
| 2,103,083 | | 12/1937 | Lynch | 601/139 |
| 2,273,207 | | 2/1942 | Kuhn . | |
| 2,567,080 | | 9/1951 | Pifer | 15/167.1 |
| 2,674,000 | | 4/1954 | McDonald, Jr. et al. | 15/167.1 X |
| 2,707,300 | * | 5/1955 | Angelillo . | |
| 3,214,776 | | 11/1965 | Bercovitz | 15/26 |
| 3,698,405 | | 10/1972 | Walker | 15/207.2 X |
| 4,039,261 | | 8/1977 | Evans | 401/268 X |
| 4,654,921 | | 4/1987 | Dinner | 15/167 |
| 4,730,361 | * | 3/1988 | Koffler . | |
| 4,847,936 | * | 7/1989 | Moglianesi et al. | 15/DIG. 5 |
| 5,048,143 | | 9/1991 | Carroll | 15/110 |
| 5,078,732 | | 1/1992 | Ceniceros | 606/235 |
| 5,291,878 | | 3/1994 | Lombardo et al. | 128/62 A |
| 5,341,537 | | 8/1994 | Curtis et al. | 15/167.1 |
| 5,353,464 | * | 10/1994 | Atkins et al. | 15/143.1 |
| 5,392,483 | | 2/1995 | Heinzelman et al. | 15/167.1 |
| 5,419,001 | * | 5/1995 | Wan | 15/DIG. 5 |
| 5,623,739 | | 4/1997 | Thompson | 15/167.1 |
| 6,009,600 | * | 1/2000 | Egeland et al. | 16/436 |

FOREIGN PATENT DOCUMENTS

| | | | | |
|---|---|---|---|---|
| 1100290 | * | 9/1955 | (FR) | 15/167.1 |

* cited by examiner

*Primary Examiner*—Gary K. Graham
(74) *Attorney, Agent, or Firm*—Holland & Knight LLP

(57) ABSTRACT

A toothbrush that facilitates brushing even by individuals with limited manipulative dexterity includes a handle, a head mechanically coupled to the handle, and an array of bristles secured to the head and extending outwardly therefrom in a plurality of directions, such that, when the head and the array of bristles are viewed in cross-section, the bristles occupy a first sector of a circular area that is greater than sixty (60) degrees, but less than or equal to two hundred forty (240) degrees of the circular area, and wherein the remaining at least one hundred twenty (120) degrees of the circular area is devoid of any bristles. Such attachment of the bristles increases the likelihood that the teeth will be brushed properly irrespective of the orientation of the head in the mouth, while also reducing the likelihood that sensitive areas of the mouth will likewise be brushed. In another embodiment, the toothbrush includes a head, an array of bristles extending outwardly from the head, and a substantially C-shaped handle mechanically coupled to the head. The C-shape of the handle enables the handle to be easily grasped by users, while also facilitating improved maneuverability of the toothbrush, providing over-insertion protection, and being amenable to caregiver assistance.

2 Claims, 3 Drawing Sheets

TOOTHBRUSH AND METHOD OF FABRICATING SAME

FIELD OF THE INVENTION

The invention relates to toothbrushes. More particularly, the present invention relates to a toothbrush that facilitates its being grasped and maneuvered even by individuals with limited manipulative dexterity, such as young children or adults with physical impairments, in order to provide effective removal of plague and foreign matter from the teeth of a user of the toothbrush.

BACKGROUND OF THE INVENTION

Toothbrushes of varying shapes and sizes are known in the prior art. A typical prior art toothbrush includes a rectangular or oval head, a handle, and a neck connecting the handle to the head. The head includes an array of bristles that are intended to remove plague and foreign matter from the teeth during use of the toothbrush. The head, neck, and handle are typically formed as an integral unit through a molding process. Typically, the central longitudinal axes of the head, neck, and handle are collinear or at least lie substantially in a common plane. In other prior art toothbrushes, the central longitudinal axis of the head may be oriented perpendicular to the central longitudinal axes of the neck and handle to form a toothbrush generally in the shape of a "T." The handle is often straight, but in some designs, is bent at certain locations and at certain angles either to make it more comfortable to hold and/or to improve the toothbrush user's ability to access hard-to-reach surfaces of the teeth.

As is known to those skilled in the art, toothbrushes clean most effectively when the toothbrush user uses the toothbrush such that the bristles are oriented substantially perpendicular to the tooth surfaces being cleaned. However, typical prior art toothbrushes can be difficult for certain individuals to use correctly and with relative ease. Such individuals who have difficulty using prior art toothbrushes include those persons who may not have full normal use of their hands and/or fingers, and/or who have impaired or underdeveloped hand or finger motor skills. Examples of such individuals include young children, arthritics, individuals with cerebral palsy, Parkinson's disease, or Alzheimer's disease, individuals with hand or finger malformities, the elderly, and persons debilitated through accident, illness and/or congenital abnormalities. For such persons, grasping a typical prior art toothbrush and properly manipulating it in the mouth during use such that the bristles engage the tooth surfaces to be cleaned substantially perpendicularly can be a difficult, if not nearly impossible, task. As a consequence, these persons oftentimes cannot, by themselves, brush their teeth in a manner sufficiently effective to maintain proper dental hygiene and oral health.

A variety of toothbrushes have been designed with the goal of aiding individuals with limited manipulative dexterity, especially children. Examples of such toothbrushes are disclosed in a variety of U.S. utility and design patents, such as U.S. Utility Pat. Nos. 1,257,883; 2,273,207; 3,214,776; 4,654,921; and 5,623,739, and U.S. Design Pat. Nos. 321,092; 324,958; and 389,312. Some of these toothbrushes typically include a closed oval or circular handle to facilitate easier gripping of the toothbrush and/or to insure that the toothbrush cannot be inserted dangerously deeply into the mouth or throat. In addition, U.S. Design Pat. No. 321,092 discloses a toothbrush having a tubular head with a circular cross-section and which bears bristles that extend outwardly from the head around the entire 360 degree perimeter of the head to virtually insure that at least some of the bristles contact the teeth irrespective of the angular orientation of the toothbrush head in the mouth.

Although prior art toothbrushes of the types described above do provide some maneuverability and gripping assistance to users, they still possess significant drawbacks. First, the closed oval or circular shape of the handles of such toothbrushes can limit a user's ability to maneuver the toothbrush in or toward the mouth area. For example, the closed loop shape of the handles of some of these brushes can impede the flex and extension movements of a user's (especially a young child's) wrist, thereby inhibiting the user's ability to properly orient the brush head in the mouth. Second, the closed loop shape of some of these brushes can also inhibit the ability of a caregiver to provide assistance or direction to an impaired user (e.g., a user with limited finger manipulative dexterity) while the user attempts to brush his or her own teeth. The closed loop handles typically do not provide enough space in the loop for both the user's fingers and two or more of a caregiver's fingers. Thus, a caregiver may not be able to provide assistance easily to an impaired user of a closed loop handle toothbrush who is in need of such assistance to brush his or her teeth. Lastly, closed loop handles do not guide the user (e.g., young child) to grasp or grip any particular part of the handle. Consequently, as the young child matures and gravitates toward using the more common straight-handled toothbrush, the child may still not be comfortable or adequate using such a straight-handled toothbrush, even though the child has been using a toothbrush with a closed loop handle, because the closed loop handle provides no direction as to the preferred location for gripping a toothbrush.

In addition to the aforementioned drawbacks related to the closed loop shape of some handles, many toothbrushes with closed loop handles include bristles that project outwardly from the head in a single general direction that is usually substantially perpendicular to a flat front surface of the head. Thus, even though an impaired user might be able to hold the oval or circularly-shaped toothbrush handle, he or she may not be able to properly orient and maneuver the tips of the bristles of the toothbrush head with respect to the tooth surfaces to be cleaned U.S. Pat. No. Des. 321,092 appears to overcome some of the orientation problem by providing a toothbrush having bristles completely around a tubular head. When such a brush is used, however, at least one-half of its bristles will, at any given time, be oriented away from the tooth surfaces to be cleaned and, thus, do not contribute to effective cleaning action. Moreover, because its bristles project radially outwardly from the entire head, sensitive areas of the mouth that are not intended to be brushed, such as the cheek, will inevitably be brushed, possibly resulting in physical damage, irritation, or at least an uncomfortable sensation in such areas during brushing. Such irritation or discomfort in and of itself may discourage regular use of such a toothbrush.

Some straight-handled toothbrushes include bristles that project outwardly over a small range of directions that occupy, when the bristles and toothbrush head are viewed in cross-section, at most about a sixty (60) degree sector of a circular area containing the bristles and head. Examples of such toothbrushes can be found in U.S. Pat. Nos. 5,341,537 and 5,392,483. These toothbrushes include bristles along the longitudinal edges of the head that are flared slightly outward to clean and massage the gums and/or gumline under the presumption that the toothbrush head itself will be properly oriented in the mouth during use. However, as described above, such a presumption may not be correct, particularly when users have limited manipulative dexterity. Consequently, the gum and gumline cleaning of such toothbrushes may never be realized by some users.

Therefore, a need exists for a toothbrush and method of fabrication thereof that not only facilitate effective brushing of the teeth by individuals with limited manipulative dexterity, but that also improve maneuverability of the toothbrush and reduce the likelihood of irritating sensitive areas of the mouth during brushing. Such a toothbrush that also is amenable to caregiver assistance, provides overinsertion protection, and encourages the user to grip the correct part of the toothbrush handle would be a further improvement over the prior art.

SUMMARY OF THE INVENTION

The present invention overcomes the foregoing problems and limitations of the prior art by providing, according to one aspect thereof, a toothbrush that includes a handle, a head mechanically coupled to the handle, and an array of bristles secured to the head and extending outwardly therefrom in a plurality of directions, such that, when the head and the array of bristles are viewed in cross-section, the bristles occupy a first sector of a circular area that is greater than sixty (60) degrees, but less than or equal to two hundred forty (240) degrees of the circular area, and wherein the remaining at least one hundred twenty (120) degrees of the circular area is devoid of any bristles. Thus, in contrast to prior art toothbrushes, the toothbrush of the present invention includes a sufficient number and angular orientation of bristles around the perimeter surfaces of the head to increase the probability of properly engaging at least some of the bristles with the tooth surfaces to be cleaned irrespective of angular orientation of the head in the mouth, while, at the same time, including sufficient empty space about the head's perimeter to reduce the likelihood of brushing sensitive areas of the mouth, such as the cheeks or lips.

According to another aspect of the present invention, the bristles are arranged into two end groups and a middle group. The middle group is positioned between the end groups and includes bristles of a first length. The end groups include bristles that are substantially equal in length, but that are longer than the lengths of the bristles in the middle group. Such a bristle arrangement is particularly applicable to a young children's toothbrush because the profile of such a bristle arrangement accommodates the characteristic of young children's teeth when their teeth are slightly closed together or clenched, as is typically the case when young children try to brush their teeth. That is, such a bristle arrangement with a shorter middle group of bristles prevents a young child from biting down on the bristles in the middle of the brush and inadvertently immobilizing the toothbrush.

According to yet another aspect of the present invention, the bristles are arranged into three groups as noted just above; however, in this embodiment, the bristles in the end groups are substantially equal in length, but are shorter than the lengths of the bristles in the middle group. Such a bristle arrangement is particularly applicable to a toothbrush for use by the elderly because elderly individuals often have recessed gumlines and, therefore, longer root surfaces that are often difficult to brush with prior art toothbrushes having uniform length bristles. In addition, elderly persons typically have areas of missing teeth, resulting in proximal surfaces of remaining teeth that are difficult to brush with prior art toothbrushes.

According to yet another aspect of the present invention, a toothbrush includes a head, an array of bristles extending outwardly from the head, and at least a three-member handle mechanically coupled to the head. The handle is constructed such that a first member of the handle is coupled to the head. Second and third members of the handle are coupled to the first member at separate locations and extend outwardly from the first member. Both the second and third members of the handle terminate in free ends to form a gap between them to facilitate wrist movement of a user of the toothbrush.

In a preferred embodiment, the aforesaid three members of the handle form a partially closed, substantially C-shape that enables the handle to be easily grasped, especially by individuals with hand, wrist, or finger dexterity impairments, while also protecting against dangerously deep insertion of the toothbrush into the mouth or throat. In contrast to prior art closed loop handles, the partially closed handle of the present invention permits substantially unimpeded flex and extension of the user's wrist during maneuvering of the toothbrush. That is, the gap in the C-shaped handle provides an opening through which the hand or wrist may pass during manipulation or maneuvering of the toothbrush in or toward the mouth area. In addition, the gap provides additional space to facilitate caregiver assistance of impaired users. Still further, the gap encourages the user to grip the first member of the handle, which preferably comprises a straight member having a longitudinal axis collinear with a longitudinal axis of the head, to thereby aid the user in gripping the correct part of handle during use of the toothbrush. In a preferred embodiment, the handle is mechanically coupled to the head by molding the toothbrush as a single, integrated unit.

As noted above, the substantially C-shape of the handle enables the handle to be easily grasped, especially by individuals with hand, wrist, or finger dexterity impairments, while also protecting against dangerously deep insertion of the toothbrush into the mouth or throat. The gap in the C-shaped handle provides an opening through which the hand or wrist may pass during manipulation or maneuvering of the toothbrush and encourages the user to grip the member of the handle that is opposite the gap.

These and other aspects and advantages of the invention will become more apparent to a person of ordinary skill in the art upon review of the following detailed description of a preferred embodiment taken in conjunction with the appended drawings in which like reference numerals designate like items.

DETAILED DESCRIPTION OF A PREFERRED EMBODIMENT

Figure 1:
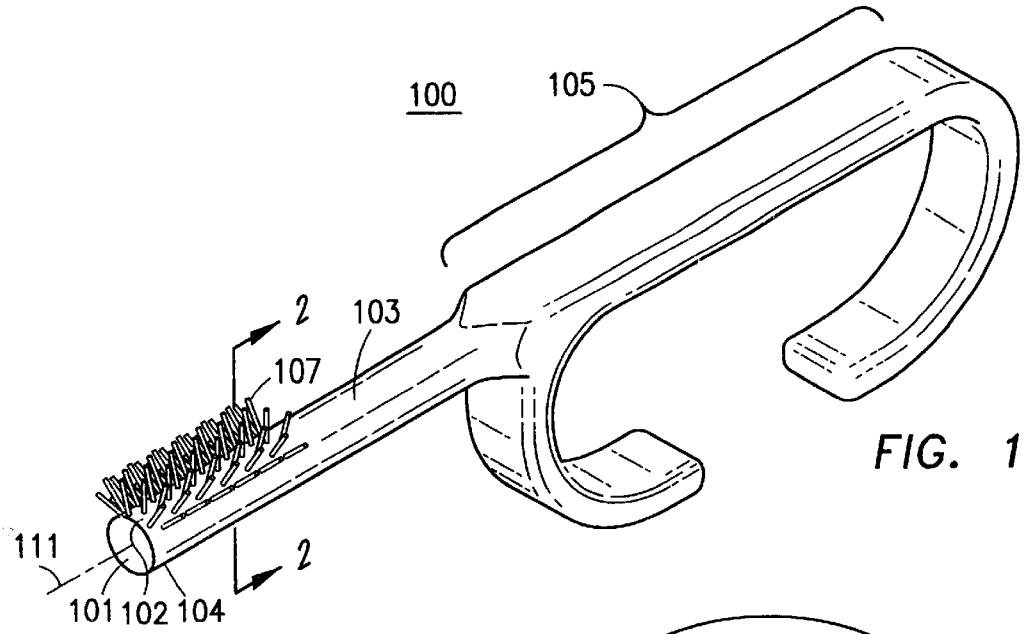
FIG. 1 is a perspective view of a toothbrush in accordance with a preferred embodiment of the present invention.

FIG. 1 illustrates a perspective view of a toothbrush 100 in accordance with a preferred embodiment of the present invention. The toothbrush 100 includes a head 101, a neck 103, a handle 105, and a plurality of bristles 107. The head 101 includes a bristle-bearing portion 102 (e.g., top halt), a non-bristlebearing portion 104 (e.g., bottom half), and a substantially central axis 111. For heads that have symmetric cross-sections, such as those illustrated in FIGS. 1–3, 8, and 10, the substantially central axis 111 preferably comprises the central axis of the head 101. For elongated, symmetrical heads, axis 111 preferably comprises the longitudinal axis located at the center the head 101. For heads that do not have symmetric cross-sections, such as those illustrated in FIGS. 7 and 9, the substantially central axis 111 comprises an axis that is reasonably close to the center of the head 101.

The bristles 107 extend outwardly from the bristle-bearing portion 102 of the head 101 in multiple directions, such that, when the head 101 and the bristles 107 are viewed in cross-section (as in FIG. 2), the bristles 107 occupy between sixty (60) and two hundred forty (240) degrees of a circular area containing the head 101 and the bristles 107. The circular area and the arrangement of the bristles 107 are described in more detail below with respect to FIG. 2.

Figure 10:
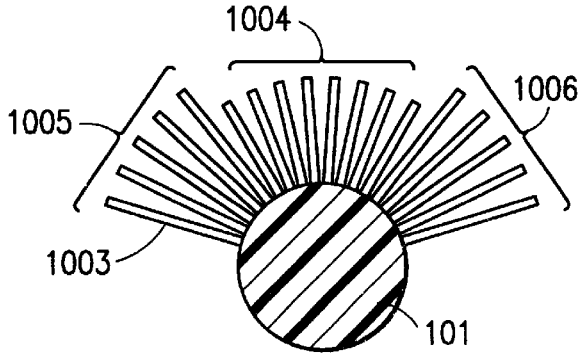
FIG. 10 is a cross-sectional view of the head of the toothbrush of FIG. 1 depicting a first alternative embodiment of the bristle arrangement.
Figure 11:
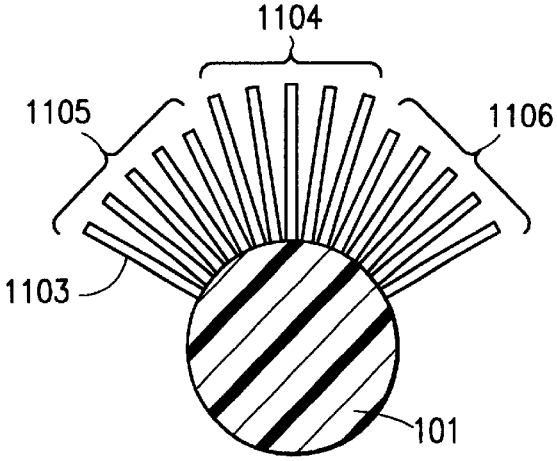
FIG. 11 is a cross-sectional view of the head of the toothbrush of FIG. 1 depicting a second alternative embodiment of the bristle arrangement.

Each bristle 107 includes a base end secured to the head 101 and a free distal end spaced apart from the base end. The free distal end or tip is the end of the bristle 107 that engages the teeth during brushing. In the preferred embodiment, the bristles 107 are preferably of equal length in the range of about ten (10) millimeters (mm) to about fifteen (15) mm as measured from the outer surface of the head 101 to the tip of each bristle 107. However, in alternative embodiments, the bristles 107 may vary in length, for example, as illustrated in FIGS. 10 and 11, and described in more detail below.

For clarity of illustration, individual bristles 107 in all FIGS. are exaggerated in both length and diameter. It is to be understood that it would be preferable to include substantially greater numbers of bristles of substantially smaller size diameter than appear to be illustrated. Indeed, what appear in the FIG. as individual bristles 107 preferably comprise bundles of bristles, each of which may contain about twenty (20) to about thirty (30) individual bristles of much smaller diameter than those illustrated.

The head 101, neck 103, and handle 105 are preferably fabricated as a single, integrated unit using well-known injection molding techniques. Thus, upon fabrication, the head 101 is coupled to the neck 103, which in turn is coupled to the handle 105 as shown in FIG. 1. Therefore, in the preferred embodiment, the neck 103 mechanically couples the head 101 to the handle 105.

The bristles 107 may be secured to the head 201 using any presently known or future developed technique. That is, the process used to secure the bristles 107 to the head 101 is of no import to the novelty of the present invention. In the preferred embodiment, the base ends of the bristles 107 are secured to the head 101 in accordance with standard toothbrush manufacturing techniques by first creating a plurality of bores in the head 101, then placing base ends of a bundle of bristles 107 into each bore, and finally trimming the free distal ends of the bristles 107 to the desired lengths.

Figure 2:
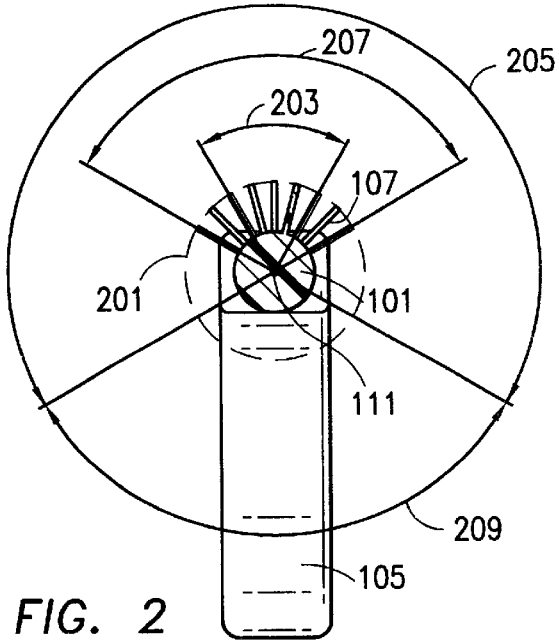
FIG. 2 is a cross-sectional view of the toothbrush of FIG. 1 viewed along the line 2—2 normal to a plane orthogonal to the axis 111 of FIG. 1.
Figure 7:
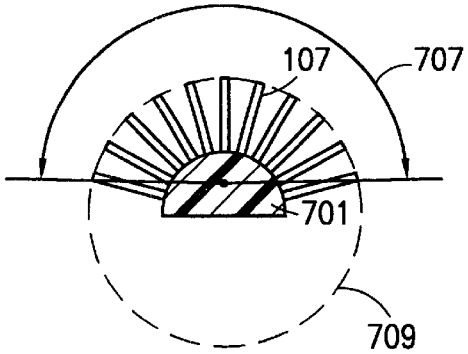
FIG. 7 is a cross-sectional view of a first alternative embodiment of the head of the toothbrush of FIG. 1.
Figure 8:
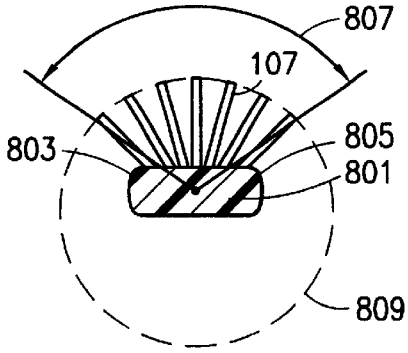
FIG. 8 is a cross-sectional view of a second alternative embodiment of the head of the toothbrush of FIG. 1.

FIG. 2 is a cross-sectional view of the toothbrush of FIG. 1 along the line 2—2. As shown, the preferred head 101 has a continuous, circular cross-section, although embodiments with segmented or piece-wise, substantially circular cross-sections or cross-sections other than circular may be employed. Examples of alternative cross-sectional embodiments of the head 101 are illustrated in FIGS. 7–9, and are described in more detail below.

The bristles 107 extend outwardly from the bristle-bearing portion 102 of the head 101 in a plurality of directions, such that, when the head 101 and the bristles 107 are viewed in cross-section, the bristles 107 occupy only part (i.e., a sector) of a circular area 201 containing the head 101 and the bristles 107. In particular, the bristles 107 occupy a sector of the circular area 201 that is greater than sixty (60) degrees (denoted by sector 203 in FIG. 2) , but less than or equal to two hundred forty (240) degrees (denoted by sector 205 in FIG. 2) of the circular area 201. In a preferred embodiment, the bristles 107 occupy a sector 207 constituting only one hundred twenty (120) degrees of the circular area 201. The sector 203, 205, 207 of the circular area 201 containing the bristles 107 is defined, for purposes of the present invention, as that portion of the circular area 201 between a first imaginary boundary formed by drawing a first imaginary line from the substantially central axis 111 of the head 101 through the free distal end of the outermost bristle at one end of the bristle array, and a second imaginary boundary formed by drawing a second imaginary line from the substantially central axis 111 of the head 101 through the free distal end of the outermost bristle at the other end of the bristle array. According to the present invention, in no event should the bristles 107 occupy the entire circular area 201 in order to reduce the likelihood that sensitive areas of the mouth, such as the cheeks or the lips, will be brushed along with the teeth. Therefore, the remaining sector 209 constituting at least one hundred twenty (120) degrees of the circular area 201 is devoid of any free distal ends of bristles 107.

Figure 9:
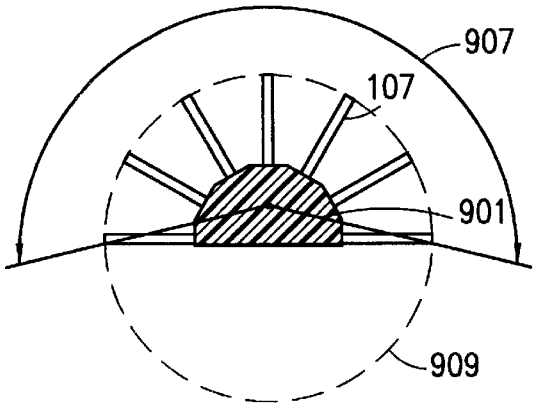
FIG. 9 is a cross-sectional view of a third alternative embodiment of the head of the toothbrush of FIG. 1.

With respect to the present invention, the important consideration with respect to securing bristles 107 about the perimeter of the head 101 is to secure the bristles 107 only to the bristle-bearing portion 102 (or portions, for example, where a segmented cross-section is used for the head 101, such as depicted in FIG. 9) of the head 101 such that the bristles 107 extend outwardly at various angles, but not around the entire perimeter of the head 101. With bristles 107 secured to the head 101 in this manner, the likelihood that the bristles 107 will properly engage the tooth surfaces during brushing is improved irrespective of the angle at which the toothbrush user aligns the head 101 with the teeth, and the likelihood that sensitive areas of the mouth will be brushed along with the teeth is reduced.

Figure 3:
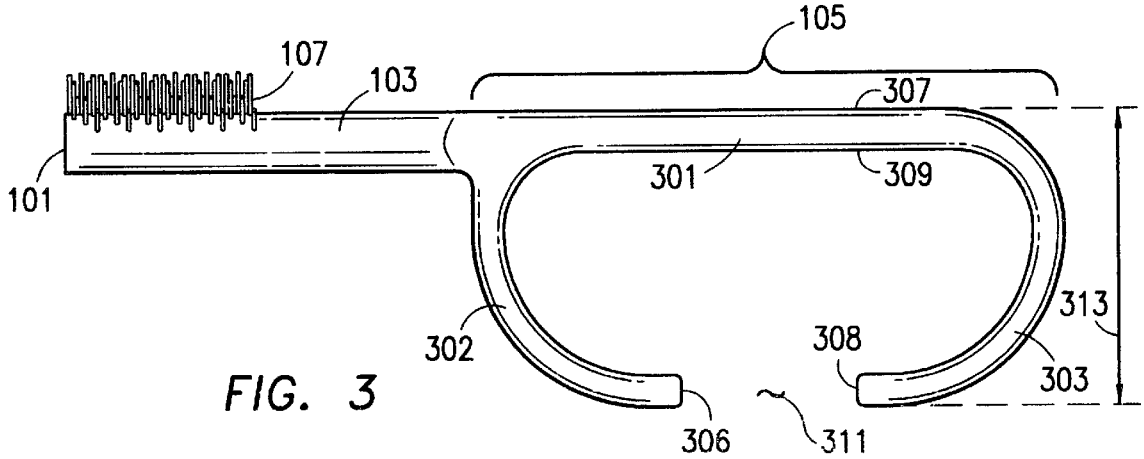
FIG. 3 is a side elevational view of the toothbrush of FIG. 1.

FIG. 3 is a side elevational view of the toothbrush 100 of FIG. 1. As shown, the toothbrush handle 105 is preferably C-shaped and includes three members 301–303. An elongated member 301 is mechanically coupled to the head 101 via the neck 103 and includes a front surface 307 and a rear surface 309. Although member 301 is preferably straight and has a longitudinal axis that extends collinearly with the longitudinal axes of the head 101 and neck 103, alternative configurations of member 301 are also possible. For example, member 301 may be angled upwardly, downwardly, or to either side at the junction where member 301 joins the neck 103 and/or may include various other angles or bends to make member 301 more comfortable to hold and/or to improve the toothbrush user's ability to access hard-to-reach surfaces of the teeth.

Members 302 and 303 are each single, non-bifurcated, generally hook shaped members which hook toward one another, are substantially the same size as one another and are shaped as substantial mirror images of one another. Members 302 and 303 are coupled at separate locations to member 301 and extend outwardly preferably with respect to the rear surface 309 of member 301. As shown, member 302 is located closer to the head 101 than is member 303. Member 302 and member 303 terminate in respective free ends 306, 308. The free ends 306, 308 of members 302 and 303 form a gap 311 of sufficient distance to permit a toothbrush user's hand or wrist to move (i.e., flex or extend) in the likely event that the user grasps the handle 105 by member 301. For an adult's toothbrush, the gap 311 is preferably in the range of about forty-five (45) mm to about ninety (90) mm; whereas, for a child's toothbrush, the gap 311 is preferably in the range of about twenty (20) mm to about forty-five (45) mm. By including an appropriately-sized gap 311 as shown, the preferred handle 105 allows movement of a user's hand or wrist without necessarily resulting in substantial movement of the toothbrush 100 due to the hand's or wrist's bumping into the section of the handle 105 not currently being grasped by the user. Thus, by including the gap 311, the present invention permits unimpeded or at least only slightly impeded flexion and extension of the wrist in contrast to prior art closed loop handles.

In addition, by including members 302 and 303 in a partially closed configuration, the toothbrush 100 provides additional grasping area that may be necessary for a caregiver to assist a user of the toothbrush. For example, with the preferred handle 105 of the present invention, a caregiver can stabilize the toothbrush user's face by gently holding a cheek with one hand and still have adequate space provided by the handle's gap 311 to assist the user in brushing his or her teeth by grasping member 303 with the other hand.

Besides providing adequate space to facilitate caregiver assistance, members 302 and 303 are preferably of sufficient size to prevent over-insertion of the toothbrush 100 into the mouth and/or throat of the user. In the preferred embodiment, the distance 313 from the front surface 307 of member 301 to the farthest points of members 302 and 303 is preferably about fifty (50) mm for an adult toothbrush and preferably in the range of about twenty-five (25) mm to about thirty-five (35) mm for a children's toothbrush. Member 302 prevents the toothbrush 101 from being inserted dangerously far into the mouth and/or throat of the user during normal use and member 303 prevents the toothbrush 101 from being inserted into the mouth and/or throat from the wrong end.

In addition to the above benefits, the gap 311 also encourages the user (e.g., young child) to grip member 301 just prior to brushing because there is no handle member spanning the gap 311 to grip. As preferably constructed, member 301 is very similar to a typical toothbrush handle. Therefore, by encouraging the user to grip member 301, the toothbrush 100 of the present invention teaches the user how to begin using more common, commercially available straight-handled toothbrushes. By contrast, closed loop handle toothbrushes do not encourage proper grip because the user is equally likely to grip either elongated member of the closed loop.

Extending handle members 302 and 303 are depicted in FIGS. 1 and 3 as preferably lying substantially in the same plane and including respective sections (e.g., sections that include free ends 306 and 308) that extend toward one another. In alternative embodiments, however, such members 302, 303 may lie in different planes and/or extend straight out from member 301 without respective sections that extend toward one another.

Figure 4:
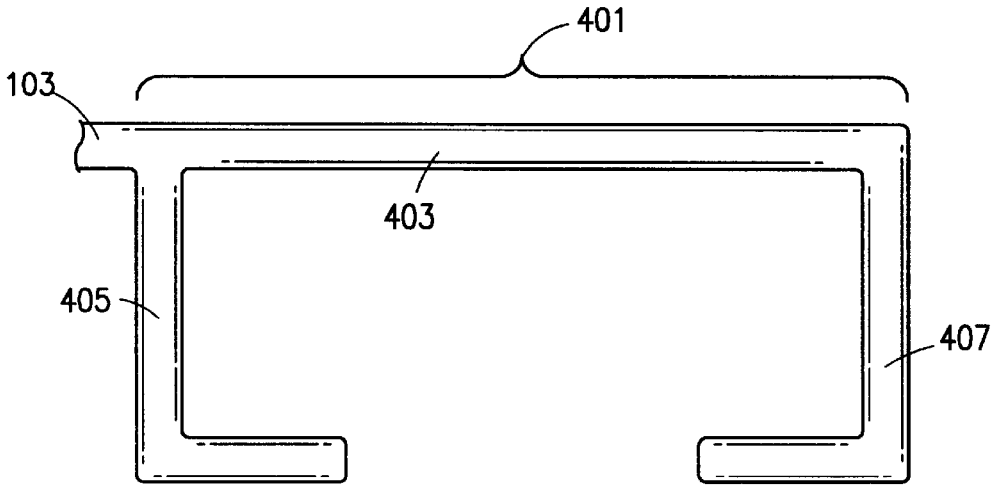
FIG. 4 is a side elevational view of a first alternative embodiment of the handle of the toothbrush of FIG. 1.
Figure 5:
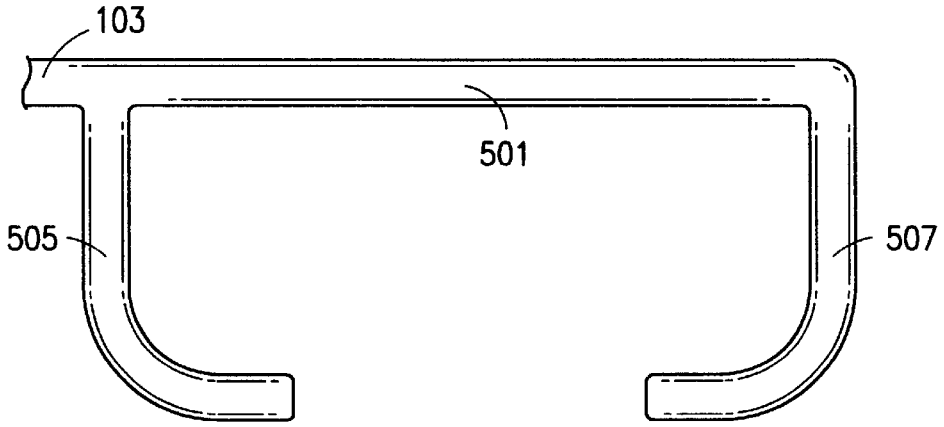
FIG. 5 is a side elevational view of a second alternative embodiment of the handle of the toothbrush of FIG. 1.
Figure 6:
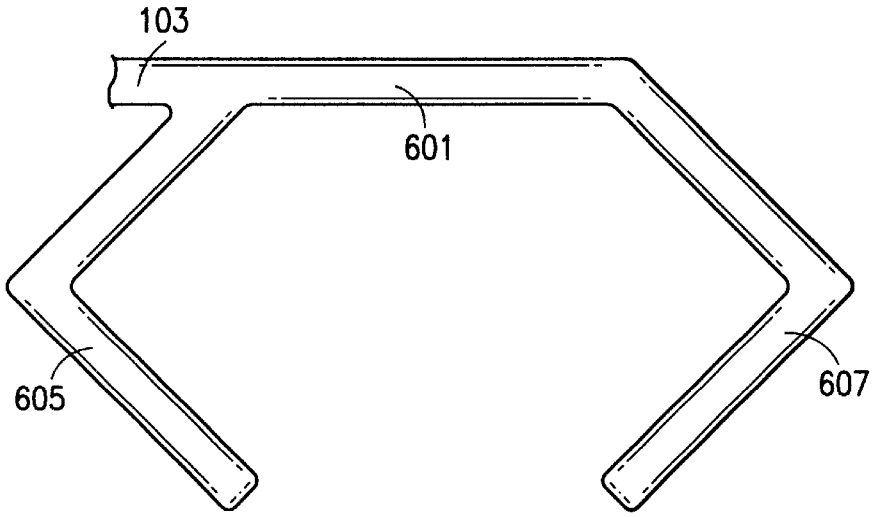
FIG. 6 is a side elevational view of a third alternative embodiment of the handle of the toothbrush of FIG. 1.

FIGS. 4–6 illustrate side elevational views of alternative embodiments of the handle 105 of the toothbrush 100 of FIG. 1. The embodiment depicted in FIG. 4 illustrates a handle 401 that is substantially, but not actually, C-shaped. That is, instead of including a straight member 301 interposed between opposing curved hook shaped members 302, 303, a straight member 403 is interposed between two mutually opposed, hook shaped members in the form of L-shaped members 405, 407. Other substantially C-shaped embodiments are also possible, including without limitation, an embodiment in which a straight member 501 is interposed between two mutually opposed, hook shaped members in the form of J-shaped members 505, 507 as depicted in FIG. 5, an embodiment in which a straight member 601 is interposed between two mutually opposed, hook shaped members in the form of sideways-lying V-shaped members 605, 607 as depicted in FIG. 6, or an embodiment in which a slightly curved or angled member is interposed between any two of the aforementioned mutually opposed members. As shown in each of FIGS. 3 through 6, the clearance across the gap formed between each pair of hook shaped members 302 and 303; 405 and 407; 505 and 507 and 607 does not exceed, in any preferred embodiment the distance between the locations on the respective elongated member 301, 403, 501 and 601 at which those respective pairs of hook shaped members are coupled to the elongated member.

Other embodiments of the handle 105, although not preferred, are also possible when used in combination with a head 101 that has attached bristles 107 that extend outwardly from the head 101 around a portion, but not all, of the perimeter of the head 101 as described above. For example, the handle 105 may be straight, closed loop, or any other shape. In these embodiments, the toothbrush enjoys the benefits of increasing the likelihood of properly engaging the bristles with the teeth and reducing the likelihood of brushing sensitive areas of the mouth, but may not enjoy one or more of the aforementioned benefits of over-insertion protection, maneuverability, and amenability to caregiver assistance.

Alternative embodiments for the bristles 107 are also possible when the handle 105 is C-shaped or substantially C-shaped. For example, the bristles 107 may extend outwardly around the entire perimeter of the head as in U.S. Design Pat. No. 321,092, which is incorporated herein by this reference. Alternatively, the bristles 107 may extend outwardly perpendicular to a flat, bristle-bearing surface of the head 101 as is typical in most prior art toothbrushes. Still further, the bristles 107 may extend outwardly on two sides of the head 101 perpendicular to opposing, flat, bristle-bearing surfaces of the head, such as is depicted in FIGS. 6 and 7 of U.S. Design Pat. No. 321,092. In these alternative embodiments, the toothbrush enjoys the benefits of over-insertion protection, maneuverability, amenability to caregiver assistance, and encouraging proper grip, but may not enjoy one or more of the benefits of increasing the likelihood of properly engaging the bristles with the teeth and reducing the likelihood of brushing sensitive areas of the mouth.

The neck 103 is simply used to mechanically couple the head 101 to the handle 105 and may be any configuration, although a straight neck 103 is preferred and included in FIGS. 1–6 for illustrative purposes. Additionally, the neck 103 is preferably constructed to be relatively short (e.g., in the range of about twenty-five (25) mm to about fifty (50) mm for an adult toothbrush and in the range of about fifteen (15) mm to about thirty-five (35) mm for a children's toothbrush) to enable members 302, 303 of the preferred handle 105 to provide over-insertion protection as described above.

FIGS. 7–9 illustrate cross-sectional views of alternative embodiments of the head 101 of the toothbrush 100 of FIG. 1. As depicted in FIG. 7, head 701 has a continuous, semi-circular cross section; whereas, in FIG. 9, head 901 has a segmented (seven segments shown) , substantially semi-circular cross-section. The segmented embodiment depicted in FIG. 9 may be extended to provide a segmented, substantially circular cross-section as referred to above with respect to FIG. 2, or a continuous semi-circle as depicted in FIG. 7 may be combined with a segmented semi-circle as depicted in FIG. 9 to produce a substantially circular cross-section having continuous and segmented portions. The cross-section depicted in FIG. 8 is substantially rectangular in that the shorter sides 803, 805 of the cross-section are curved slightly, as is the case with typical prior art toothbrushes. In the embodiments depicted in FIGS. 7 and 8, the heads 701, 801 include a single bristle-bearing portion 703, 807 and one or more nonbristle bearing portions 704, 803–805. In contrast, the embodiment depicted in FIG. 9 depicts a single non-bristle-bearing portion 910 and multiple bristle bearing portions 903–908 (i.e., each segment of the head 901 from which a bristle 107 or bundle of bristles extend is considered a bristle-bearing portion). As was the case for the preferred toothbrush 100 discussed above, the bristles 107 secured to each alternative embodiment of the head 701, 801, 901 extend outwardly from the bristle-bearing portion or portions of the respective head 701, 801, 901 in multiple directions, such that, when the head 701, 801, 901 and the bristles 107 are viewed in cross-section, the bristles 107 occupy a sector 707, 807, 907 of a respective circular area 709, 809, 909 containing the head 701, 801, 901 and the bristles 107. The sector 707, 807, 907 occupied by the bristles 107 is greater than sixty (60) degrees, but less than or equal to two hundred forty (240) degrees of the respective circular area 709, 809, 909 as discussed above with respect to the preferred toothbrush 100.

FIG. 10 is a cross-sectional view of the head 101 of the toothbrush 100 of FIG. 1 depicting a first alternative embodiment of the bristle arrangement. This alternative bristle arrangement includes bristles 1003 of varying lengths forming three groups 1004–1006: a middle group 1004 and two end groups 1005, 1006. Middle group 1004 is positioned between end groups 1005 and 1006, and includes bristles 1003 that are shorter in length than are the bristles of the end groups 1005, 1006. The bristles 1003 of the end groups 1005, 1006 are substantially equal in length. For example, the lengths of the bristles 1003 of middle group 1004 might be in the range of about six (6) mm to about nine (9) mm as measured from the surface of the head 101 to the free distal ends of the bristles 1003; whereas, the lengths of the bristles 1003 in the end groups 1005, 1006 might be in the range of about ten (10) mm to about fifteen (15) mm. By arranging the bristles 1003 to have a shorter middle section, this bristle arrangement profile more closely resembles the characteristic of a child's dentition that is likely to exist during brushing of the child's teeth. That is, since children often clench their teeth during brushing, providing shorter length bristles in the middle of the bristle arrangement reduces the likelihood that a child will bite down on the bristles and thereby inhibit movement of the head 101 in the mouth. Accordingly, such an arrangement of the bristles 1003 would be most applicable for use in a children's toothbrush.

FIG. 11 is a cross-sectional view of the head 101 of the toothbrush 100 of FIG. 1 depicting a second alternative embodiment of the bristle arrangement. Similar to the bristle arrangement embodiment discussed above with respect to FIG. 10, this alternative bristle arrangement includes bristles 1103 of varying lengths forming three groups 1104–1106: a middle group 1104 and two end groups 1105, 1106. Middle group 1104 is likewise positioned between end groups 1105 and 1106, and the bristles 1103 of end groups 1105, 1106 are substantially equal in length. However, in contrast to the bristle arrangement of FIG. 10, the middle group 1104 of this bristle arrangement includes bristles 1103 that are longer in length than are the bristles of the end groups 1105, 1106. For example, the lengths of the bristles 1103 of middle group 1104 might be in the range of about ten (10) mm to about fifteen (15) mm as measured from the surface of the head 101 to the free distal ends of the bristles 1103; whereas, the lengths of the bristles 1103 in the end groups 1105, 1106 might be in the range of about seven (7) mm to about eleven (11) mm. By arranging the bristles 1003 to have a longer middle section, this bristle arrangement would be most applicable to a toothbrush for use by elderly individuals that exhibit gum recession and/or are missing teeth. The longer middle group bristles enable such individuals to more effectively brush the long root surfaces of teeth in areas of gum recession, the proximal surfaces of teeth adjacent gaps left by missing teeth, and gum areas in the gaps left by missing teeth.

It should be noted that the lengths of the bristles in FIGS. 10 and 11 are exaggerated in length to illustrate the bristle length variation between the middle groups 1004, 1104 and the end groups 1005–1006, 1105–1106 in each alternative embodiment. The preferred ranges of actual lengths of the bristles in each group 1004–1006, 1104–1106 are stated above.

The present invention encompasses a toothbrush that facilitates brushing even by individuals with limited manipulative dexterity and a method of fabricating such a toothbrush. With this invention, users with limited hand, wrist, or finger manipulative dexterity have a higher likelihood of brushing their teeth properly, while reducing the likelihood of having to endure pain and discomfort associated with brushing sensitive areas of their mouths. In addition, the present invention facilitates increased maneuverability of the toothbrush as compared with closed-handled toothbrushes of the prior art, while maintaining the over-insertion safety features of such closed-handled toothbrushes. Furthermore, the present invention encourages proper grip of a toothbrush in contrast to brushes with closed loop handles. Finally, although the present invention is most beneficial to those users with limited manipulative dexterity, the present invention may be used on an everyday basis by all persons, regardless of their dexterous capabilities.

While the foregoing constitute certain preferred and alternative embodiments of the present invention, it is to be understood that the invention is not limited thereto and that in light of the present disclosure, various other embodiments will be apparent to persons skilled in the art. Accordingly, it is to be recognized that changes can be made without departing from the scope of the invention as particularly pointed out and distinctly claimed in the appended claims which shall be construed to encompass all legal equivalents thereof.

I claim:

1. A toothbrush, comprising:

a head having a longitudinal axis;

an array of bristles secured to said head and extending outwardly therefrom;

a handle offset from said head in a direction parallel to said axis, and an elongated neck interposed between said head and said handle, said neck mechanically coupling said head to said handle and offsetting said handle from said head in said direction, said handle having an elongated member and a single, non-bifurcated, first hook shaped member mechanically coupled to said elongated member at a first location adjoining said neck, said first hook shaped member having a first free end spaced from said elongated member, said handle further having a single, non-bifurcated, second hook shaped member mechanically coupled to said elongated member at a second location spaced a distance along said elongated member from said first location, said second hook shaped member having second free end spaced from said elongated member, each of said free ends being spaced substantially the same distance from said elongated memeber, said first and second hook shaped members being of substantially the same size as one another and being mutually opposed to hook toward one another, said first free end and said second free end being mutually spaced from one another to define a gap between said first free end and said second free end, said gap having a clearance not exceeding said distance between said first location and said second location.

2. The toothbrush of claim 1 wherein said array of bristles being arranged such that when said head and said array are viewed in cross section normal to any plane traversing said array in an orientation orthogonal to said axis, said array is substantially devoid of bristles within a sector of said plane having a vertex at said axis and an angle of not less than one hundred twenty degrees (120°).

* * * * *